US011125501B2

(12) United States Patent
Böhn et al.

(10) Patent No.: US 11,125,501 B2
(45) Date of Patent: Sep. 21, 2021

(54) DRYER FOR A TEXTILE MATERIAL WEB HAVING A DEVICE FOR DETERMINING THE RESIDUAL MOISTURE OF A MATERIAL WEB AND METHOD, MODULE, AND SYSTEM THEREFOR

(71) Applicants: Truetzschler GmbH & Co. KG, Moenchengladbach (DE); Reifenhäuser GmbH & Co. KG Maschinenfabrik, Troisdorf (DE)

(72) Inventors: Markus Böhn, Hainburg (DE); Andreas Rösner, Bonn (DE)

(73) Assignees: TRUETZSCHLER GMBH & CO. KG, Moenchengladbach (DE); REFENHÄUSER GMBH & CO. KG MASCHINENFABRIK, Troisdorf (DE)

( * ) Notice: Subject to any disclaimer, the term of this patent is extended or adjusted under 35 U.S.C. 154(b) by 104 days.

(21) Appl. No.: 16/491,153

(22) PCT Filed: Feb. 15, 2018

(86) PCT No.: PCT/EP2018/053735
§ 371 (c)(1),
(2) Date: Sep. 4, 2019

(87) PCT Pub. No.: WO2018/177648
PCT Pub. Date: Oct. 4, 2018

(65) Prior Publication Data

US 2020/0033059 A1 Jan. 30, 2020

(30) Foreign Application Priority Data

Mar. 30, 2017 (DE) ..... 102017106887.2

(51) Int. Cl.
*F26B 3/00* (2006.01)
*F26B 21/08* (2006.01)
(Continued)

(52) U.S. Cl.
CPC ..... *F26B 21/08* (2013.01); *F26B 3/06* (2013.01); *F26B 13/08* (2013.01); *F26B 13/30* (2013.01);
(Continued)

(58) Field of Classification Search
CPC ..... F26B 21/08; F26B 21/04; F26B 21/10; F26B 21/12; F26B 3/06; F26B 13/08; F26B 13/30; F26B 13/06; F26B 25/22
(Continued)

(56) References Cited

U.S. PATENT DOCUMENTS 4,270,283 A * 6/1981 Ellis ..... F26B 13/10 34/212
5,625,962 A * 5/1997 Fleissner ..... F26B 13/16 34/446
(Continued)

FOREIGN PATENT DOCUMENTS

CN 106017025 A 10/2016
DE 3901378 A1 8/1989
(Continued)

OTHER PUBLICATIONS

International Search Report in PCT/EP2018/053735 dated May 4, 2018.
Written Opinion for PCT/EP2018/053735 completed Apr. 23, 2018.

*Primary Examiner* — John P Mccormack
(74) *Attorney, Agent, or Firm* — FisherBroyles, LLP; Robert Kinberg

(57) ABSTRACT

A dryer for a web of textile material having at least one dryer compartment, in which at least one air-permeable cylinder is
(Continued)

rotatably disposed, around which the web of material may partially loop so that heated drying air may flow through the web of material. At least one fan is provided by which humid drying air from the inside the at least one cylinder may be suctioned off from a front-sided opening of the at least one cylinder and discharged as discharge air through a duct. The dryer includes at least one sensor for determining the humidity of the discharge air flow, the data thereof being processed in a control with the initial humidity of the web of material and the humidity of the fresh air flow for closed loop control of the evaporative capacity of the dryer.

15 Claims, 5 Drawing Sheets

(51) Int. Cl.

| | |
|---|---|
| ***F26B 3/06*** | (2006.01) |
| ***F26B 13/08*** | (2006.01) |
| ***F26B 13/30*** | (2006.01) |
| ***F26B 21/10*** | (2006.01) |
| ***F26B 21/12*** | (2006.01) |
| ***F26B 25/22*** | (2006.01) |

(52) U.S. Cl.
CPC ..... *F26B 21/10* (2013.01); *F26B 21/12* (2013.01); *F26B 25/22* (2013.01)

(58) Field of Classification Search
USPC ..... 34/446, 452, 507, 115
See application file for complete search history.

(56) References Cited

U.S. PATENT DOCUMENTS

| | | | | |
|---|---|---|---|---|
| 6,584,703 | B1 * | 7/2003 | Maenpaa | D21G 1/0093 34/444 |
| 2007/0283827 | A1 | 12/2007 | Jung et al. | |
| 2015/0198368 | A1 * | 7/2015 | Schmit | F26B 21/004 34/443 |

FOREIGN PATENT DOCUMENTS

| | | | |
|---|---|---|---|
| DE | 102012109878 | B4 | 4/2015 |
| WO | 2004/002905 | A1 | 1/2004 |
| WO | 2012/085926 | A1 | 6/2012 |

* cited by examiner

DRYER FOR A TEXTILE MATERIAL WEB HAVING A DEVICE FOR DETERMINING THE RESIDUAL MOISTURE OF A MATERIAL WEB AND METHOD, MODULE, AND SYSTEM THEREFOR

CROSS-REFERENCE TO RELATED APPLICATIONS

This application is a U.S. National Stage Application of International Patent Application No. PCT/EP2018/053735, filed Feb. 15, 2018, which claims benefit of German Patent Application No. 10 2017 106 887.2, filed Mar. 30, 2017.

BACKGROUND OF THE INVENTION

The present invention relates to a dryer for a web of textile material with at least one dryer compartment, in which at least one air-permeable cylinder is rotatably disposed, around which the web of material may partially loop, and wherein heated drying air may flow through the web of material, wherein at least one fan is provided, by means of which humid drying air from the inside of the cylinder may be suctioned out of a front-sided opening of the at least one cylinder.

German patent document DE 10 2012 109 878 B4 discloses a dryer for a web of textile material, with a dryer compartment, in which several air-permeable cylinders are rotatably disposed, around which the web of material may partially loop. Heated drying air, which absorbs the humidity from the web of material, flows through the web of material. One fan, by means of which humid drying air is suctioned from the inside of the cylinder from an opening of the cylinder, is associated to each cylinder. In this case, heat is supplied to the drying air via a circulation and the heated drying air is returned back into the dryer compartment.

Heating elements, which are disposed in the heating and fan compartment, serve for the heat input, which is necessary for heating the drying air. The heating elements are disposed such that the air flow of the drying air flowing out radially or tangentially from the fan flows around the elements. If for example three cylinders are provided, around which, one after the other, the web of textile material is guided, so are provided at least three drying air circuits, which are at least partially separated from each other, and an associated fan generates each drying air circuit. In this case, each drying air circuit has its own associated heating element, such that the heat supply is separately realized to each drying air circuit.

When the web of textile material enters via an inlet roller and loops around the cylinders one after the other, the drying of the web of textile material is gradually realized successively. In this case, withdrawing the humidity from the web of textile material is not realized homogenously in each dryer compartment and at a constant drying gradient, the web of textile material rather passes a drying cascade in several dryer compartments, and the drying degree of the web of textile material, which leaves the dryer again via a discharge roll, should have a required residual humidity. Ideally in this case, the drying is realized at a minimum energy input into the dryer such that for example a residual humidity of 8% is given in the web of textile material upon leaving the dryer, so that the energy input via heat supply and via the operation of the fan should be at a minimum for the entire dryer.

According to the state-of-the-art the determination of the residual humidity is realized by a measurement of the initial humidity of the web of material upon entry into the dryer and by a measurement of the final humidity of the web of material upon exiting from the dryer. Known measuring methods of the final humidity of the web of material require a minimum humidity, wherein it is assumed that the fibres of the web of material are able to absorb and to store humidity. In case of fibres from non-natural materials, such as spun-bonded webs, endless filaments or staple fibres from plastic material, the fibres are not able to store humidity, but they entrain humidity by adhesion. Therefore, precise measurements in the range of a maximum of 1% specific humidity are not possible, in particular not if the web of material has very low weights per unit area, for example in the range of 10 g/m2. As the fibres are not able to absorb and to store any humidity, the measurement is made more difficult and thereby becomes inaccurate. With regard to the measurement accuracy to be achieved in a continuously running web of material the available measuring instruments are disproportionately expensive.

SUMMARY OF THE INVENTION

An object of the invention is the further development of a dryer for drying a web of textile material and the further development of a method for operating such a dryer, wherein the dryer and the method are to allow for a drying of the web of textile material with an as minimum as possible an energy consumption. In this case, the residual humidity of the web of material should be determinable and the dryer with the drying capacity thereof should be adjustable to a certain residual humidity. Furthermore, it is an object of the invention to provide an inexpensive module for retrofitting to a dryer, by means of which module the residual humidity of a web of material is determinable at sufficient accuracy. Finally, it is an object of the invention to provide an installation for manufacturing a spun-bonded web, by means of which installation the residual humidity of the web of material at the end of the drying process is adjustable.

The above and other objects are achieved based on a dryer for a web of textile material, which in one embodiment comprises: at least one dryer compartment including at least one rotatably disposed air-permeable cylinder having an inside and a front-sided opening and around which the web of textile material may partially loop so that a drying heated fresh air flow may flow through the web of textile material; at least one fan arranged to suction off humid drying air from the inside of the cylinder from the front-sided opening of the at least one cylinder and to discharge the suctioned off humid drying air as discharge air flow through a duct; at least one humidity determining sensor that produces data representing the humidity of the discharge air flow; and a control coupled to the at least one sensor to process the data with an initial humidity of the web of textile material and a humidity of the fresh air flow, the control being arranged to provide a closed loop control of an evaporative capacity of the dryer as a function of a deviation of the humidity of the discharge air from a desired residual humidity.

According to another aspect of the invention, there is provided a method for operating a dryer for a web of textile material with at least one dryer compartment, wherein in one embodiment the method comprises steps of: rotatably disposing in the dryer compartment at least one air-permeable cylinder around which the web of textile material partially loops; flowing a drying heated fresh air flow through the web of textile material; suctioning off through a duct with at least one fan humid drying air as discharge air from an inside of the at least one air-permeable cylinder from a front-sided opening of the at least one air-permeable cylinder; detecting values of at least a temperature and a humidity of the fresh air flow; detecting a value of a temperature, a volume flow rate and a humidity of the discharge air; detecting values of at least a mass flow rate and a humidity of the web of textile material entering the dryer; inputting into a control a value for a reference variable for a desired residual humidity of the web of textile material; calculating an evaporative capacity of the dryer from the detected values in a control; and upon deviation of the evaporative capacity of the dryer from the reference variable, controlling at least one of the at least one heating element and the at least one fan while selectively considering at least one of an energy optimization and a cost optimization.

The invention includes the technical teaching that the dryer includes at least one sensor for determining the humidity of the discharge air flow, the data thereof being processed in a control with the initial humidity of the web of material and the humidity of the fresh air flow and thereby the evaporative capacity of the dryer being closed-loop controlled.

The core idea of the invention is the approach to detect the residual humidity in the web of material by considering the mass balance in a control. The evaporative capacity of the drying process is calculated in the control via the mass flow rate of the discharge air and the specific humidity thereof. The difference from the amount of water (initial humidity of the web of material and initial humidity of the fresh air) input into the process and the humidity of the discharge air resulting from the evaporative capacity of the dryer results in the remaining amount of water in the web of material. Furthermore, the control is able to process disturbance variables.

For this purpose, in addition to the control in the duct for the discharge air, preferably the dryer includes at least one sensor, which detects the temperature, the volume flow rate and the humidity of the discharge air. The initial humidity of the web of material and the humidity of the fresh air flow are deducted from the humidity of the discharge air (absolute or relative), in order to determine the residual humidity of the web of material. As the evaporative capacity of the dryer may be detected via the parameters, inversely the energy requirement of the dryer may be minimized with a specified residual humidity, because the heating capacity and/or the suctioned volume of the discharge air flow are/is adjustable via the control. Unlike the state-of-the-art, a simple and inexpensive sensor system may be used, in which the continuous process does not have to be interrupted for taking samples.

In a preferred embodiment, the sensor for determining the volume of the discharge air includes an orifice plate, or is formed according to the swirl flow measurement. In the application case, both variants allow for a particular operationally safe, sufficiently precise and inexpensive measuring instrument. As a further alternative, an ultra-sonic volume flow rate measurement may be used and/or the characteristics of the fan may be involved in the analysis.

Likewise, the temperature, the mass flow rate and the humidity of the web of material may be determined via at least one sensor, which is or which are disposed at or upstream the dryer. As an alternative to the sensor, the absolute or relative humidity of the web of material may be determined based on existing parameters from the installation components, which are disposed in the travelling direction of the web of material upstream the dryer, and the data may be input into the control. These components may be for example the kiss-roll and/or the batch-station, in which the reviving agent is mixed with water.

Preferably, the control includes at least one process module and an energy module. The energy module cooperates with the control of the at least one heating element and/or with the control of the at least one fan. The calculation of the mass balance of the humidity values is realized in the process module. In the event of a deviation from a reference variable of the desired residual humidity of the web of material, the process module controls the energy module, which in turn detects the minimum energy requirement for an increased or decreased drying capacity and optionally controls the one or more heating elements and/or the fans.

The inventive method, at least, is characterized by the following steps:

- detecting at least the temperature and the humidity of the fresh air,
- detecting the temperature, the volume flow rate and the humidity of the discharge air,
- detecting at least the mass flow rate and the humidity of the web of material entering the dryer,
- inputting into a control a reference variable for the desired residual humidity of the web of material,
- calculating the previously detected values in a control and, in the event of a deviation from the reference variable, controlling the heating elements and/or the fans while considering a minimum needed overall energy.

The inventive method is based on the findings that, when considering the mass balance of the humidity introduced into the dryer, the evaporative capacity of the dryer may be minimized. In particular with an adjusted residual humidity of the web of material, which is exclusively calculated and not measured, the radiometric measurement of the continuously running web of material downstream the dryer, which is required according to the state-of-the-art, may be foregone. The method may be operated with a minimum of inexpensive sensor technology. Specifically, for webs of material having a low weight made from fibres (e.g. spunbonded web), which are not able to store humidity, the method is particularly well suited on account of the accuracy thereof.

Preferably, the detection of the humidity and of the temperature of the fresh air is realized with the same sensors, which deliver the data for the discharge air. For this purpose, an empty run of the dryer without heating elements being switched on and without a web of material is required, because the ambient air in the production hall does not continuously change. Thereby, namely the humidity and the temperature of the ambient air of the dryer are determined, which receive fresh air from the environment (production hall). The set of sensors, which otherwise would have to be disposed at the intake into the dryer, where the fresh air is drawn in, may be foregone. Finally, the volume of the fresh air, required for calculating the mass balance, is determined from the fan capacity of the dryer. Thereby, in a first approach, initially it is assumed that the quantity of fresh air equals the quantity of discharge air. In the event, depending on the structure of the dryer, it becomes known that also false air has a significant influence on the mass balance, then also the volume of fresh air needs to be measured during the empty run such as to include the volume of false air in the consideration of the disturbance variable. Then, the measurement of the volume of fresh air may be likewise measured via the sensor for determining the discharge air in the duct for the discharge air.

The discharge air is monitored as well in terms of temperature, volume flow rate and humidity by means of sensors. In addition to values for the mass flow rate and the humidity of the web of material, the values are the most critical measurement values of the method. Therefore, by way of example the volume flow rate is determined by means of the precise and inexpensive throughflow measurement, or as an alternative by means of swirl flow measurement or other methods.

Detecting the mass flow rate and the humidity of the web of material entering the dryer may be realized by means of sensors, or mathematically determined, or may be realized based on the operational data of an upstream installation component, for example the kiss roll and/or the batch station. In particular the mathematical determination or the use of the operational data of an upstream installation component may increase the accuracy of the method and make it less expensive, because for example again a radiometric method for determining the humidity of a continuously running web of material may be foregone. The further advantage is found in the application for low humidity values and for low weights per unit area of the web of material, because herein the mathematical method may be more precise than the known measuring methods.

Preferably, known disturbance variables, such as for example false air at the dryer, non-homogenous reviving agents and/or fluctuations of the humidity across the working width of the web of material are input into and processed in the control.

The inventive module for the use at a dryer for determining the residual humidity of a dried web of material comprises a control with at least one process module for calculating the mass balance of the specific or the relative humidity of the fresh air, of the discharge air and of the web of material, an energy module for activating at least one heating element and at least one fan, with sensors for determining the temperature, the humidity and the volume flow rate of the fresh air and of the discharge air of the dryer. Thereby, an inexpensive retrofitting module is created, by means of which existing dryers with continuously running web of material may be retrofitted. Expensive radiometric measuring instruments downstream the dryer or complicated taking of samples at the web of material may be foregone.

Preferably, the module may be completed with sensors for determining the temperature, the mass flow rate and the humidity of a continuously running web of material, if process data from the installation components in the running direction of the web of material upstream the dryer are not available.

For processing disturbance variables, the module may include an interface or an input device.

Preferably, the inventive dryer, the method and the module are used for installations for manufacturing webs of material made from plastic material, endless filaments, such as spun-bonded webs or staple fibres made from non-natural fibres, which, unlike the webs of material made from natural fibres, are not able to store humidity.

BRIEF DESCRIPTION OF THE DRAWINGS

Further measures enhancing the invention will be illustrated in more detail in the following in conjunction with the description of one preferred exemplary embodiment of the invention based on the Figures. It is shown in.

DETAILED DESCRIPTION OF THE INVENTION

Figure 1:
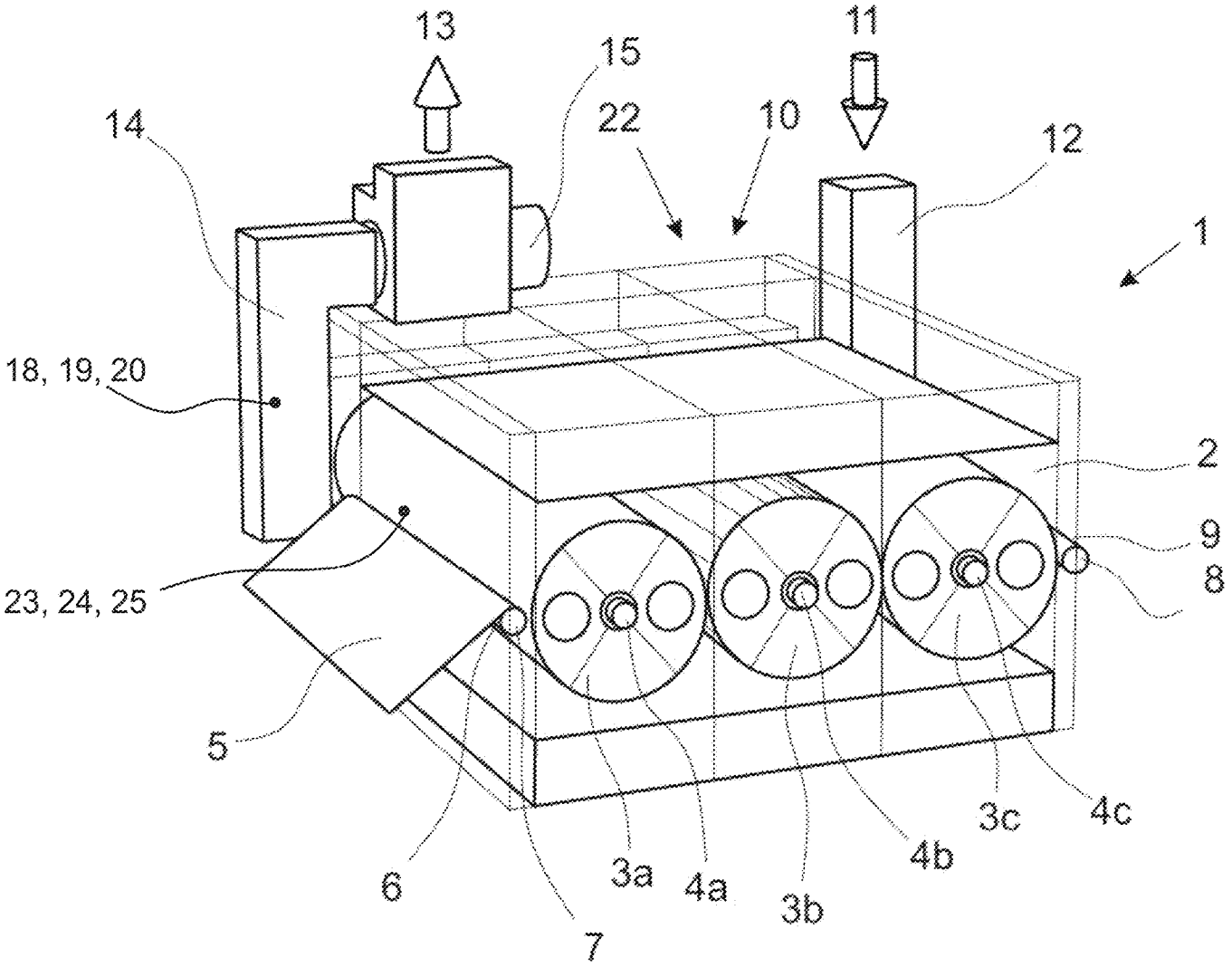
FIG. 1: a perspective view of a series dryer.

In a perspective view, FIG. 1 shows a dryer 1, which is formed as a series dryer. Within a dryer compartment 2, three cylinders 3*a*, 3*b*, 3*c* are disposed one after the other and with the axes 4*a*, 4*b*, 4*c* thereof in a row. A web of material 5 is guided via an intake 6 into the dryer compartment 2. Firstly, via a deflecting roll 7, the web of material 5 is guided below the first cylinder 3*a*, then above the second cylinder 3*b* and, subsequently below the third cylinder 3*c*. Via a deflecting roll 8, the web of material 5 is guided out of the dryer compartment 2 through an exit 9. While passing through the dryer compartment 2 heated drying air flows through the web of material 5. In this case, the drying air absorbs the humidity of the web of material 5 and is suctioned off via the inside of the cylinders 3*a* to 3*c*.

An additional chamber 10, into which the duct 12 for the fresh air 11 and the duct 14 for the discharge air 13 end, may be disposed at the dryer compartment 2. The additional chamber 10 may be built completely distinct and separately from the dryer compartment 2. The heating and fan compartment 22 is disposed at the additional chamber 10. The dryer compartment 2 is connected to the heating and fan compartment 22 by means of air ducts above and below the cylinders 3*a* to 3*c*. The additional chamber 10 is connected to the dryer compartment 2 via the front-sided opening of the cylinders 3*a* to 3*c*. The duct connection 15 may be used as the connection for a heat exchanger. In this embodiment, sensors 18, 19, 20 for detecting the temperature, the volume flow rate and the humidity of the discharge air 13 are disposed in the duct 14. The humidity of the web of material 5 may be determined by means of sensors 23, 24, 25 in the area of the intake 6 at or upstream the dryer 1, wherein herein also the temperature, the mass flow rate and the humidity of the web of material 5 may be detected.

Figure 2:
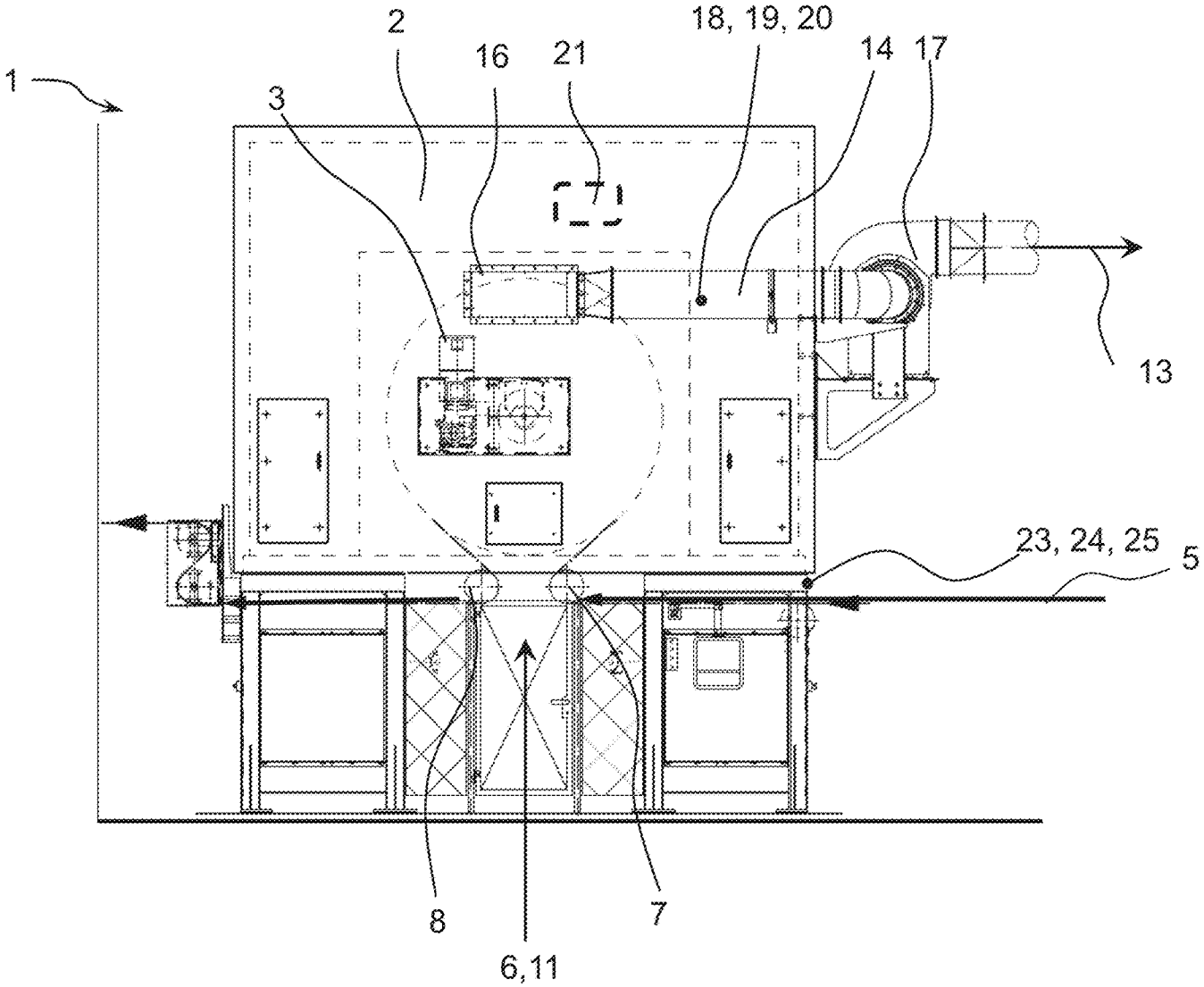
FIG. 2: a sectional illustration of a further dryer with a cylinder.

FIG. 2 shows a dryer 1 with only one cylinder 3, in which the web of material 5 enters the dryer 1 from the right hand side through an intake 6. By means of a first deflecting roll 7, the web of material 5 is directed into the dryer compartment 2, guided around the cylinder 3, and guided out of the dryer compartment 2 by means of the deflecting roll 8. The fresh air 11 is suctioned into the dryer 1 through the intake and distributes laterally below the cylinder 3 in the entire dryer compartment 2. A non-illustrated screening element ensures that the suctioned fresh air is not directly suctioned into the cylinder 3. A heating element 21, e. g. a burner, heats the suctioned fresh air, which is suctioned in through a fan 17 at a front side of the cylinder 3. Based on the pressure difference generated by the fan 17, initially the heated fresh air flows through the perforated cover 16, which harmonizes the flow. Subsequently, the heated fresh air flows through the cylinder 3 with the web of material 5 looped around the cylinder 3 and thereby absorbs the humidity from the web of material 5. The thereby generated discharge air 13 is removed via the duct 14.

According to the invention, the determination of the residual humidity in the web of material 5 is realized by means of examining the mass balance in a control. It is via the mass flow rate of the discharge air 13 and the specific humidity thereof that the evaporative capacity of the drying process is calculated in the control. The difference from the amount of water (initial humidity of the web of material and initial humidity of the fresh air) input into the process and the evaporative capacity of the dryer (humidity of the discharge air) results in the remaining amount of water in the web of material.

For this purpose, sensors 18, 19, 20, which measure the temperature, the air volume and the humidity of the air flow, are installed in the duct 14 for the discharge air 13. The values for the initial humidity of the fresh air 11 may be measured with the same sensors 18, 19, 20 as the values for the humidity of the discharge air 13. Herein, prior to starting the dryer 1, with the heating element being switched off and the web of material 5 not being introduced, fresh air 11 is suctioned in via the fan 17 and measured by the sensors 18, 19, 20. The measured values serve as a point zero or reference for the mass balance. Only for important deviations in the temperature or the air humidity in the facility hall the measurement would have to be repeated under the same conditions. In the event a gas burner is used as the heating element 21, the burner additionally introduces water into the drying process by means of the burning process. Via the gas consumption, the water proportion is considered in the calculation of the final humidity. However, the required values for the initial humidity of the fresh air 11 may as well be determined from the ambient air of the dryer 1, because the fresh air 11 is suctioned in from the environment of the dryer 1. While considering that no mentionable proportion of false air needs to be taken into account, the volume of the fresh air 11 is determined by the fan capacity.

The humidity of the discharge air 13 is likewise measured via the sensors 18, 19, 20 in the duct 14. The sensor 18 senses the temperature in degree Celsius, the sensor 19 the volume flow rate of the discharge air 13 in $m^3/h$ and the sensor 20 the humidity in the discharge air 13 in $kg/m^3$. In this case, potential pressure differences between the discharge air 13 and the fresh air 11 may be neglected in the mass balance. Normally in this case, the volume flow rate of the discharge air 13 equals the volume flow rate of the fresh air 11 suctioned in, because with the suction capacity of the fan 17 also false air will be suctioned through the web of material 5 and the cylinders 3*a* to 3*c* through the duct 14.

The entry humidity, which enters the dryer 1, may be likewise measured in the web of material 5 in that for example a sensor 25 for measuring the humidity is disposed upstream the intake 6 of the dryer 1 or at an upstream disposed installation component, for example a kiss roll or a pair of squeezing rolls. As an alternative, the entry humidity may be indirectly determined by a parameter from the process upstream the dryer, for example by means of the consumption of liquid of a kiss roll or from the difference between liquid input into the web of material and the removal of residual liquid into a recycling installation. In particular with a kiss roll or a foulard disposed upstream the dryer 1, the application of reviving agent, respectively of liquid may be determined by means of filling level sensors. As the mass throughput and the weight per unit area of the web of material upstream the kiss roll or the foulard are known, the proportion of the liquid and thereby the specific humidity of the web of material may be determined prior to the web of material entering the dryer. Among others, evaporation and/or blending, respectively spraying-off when applying the liquid and the deflection of the web of material may be detected empirically and taken into account.

The sensor 18 for measuring the temperature of the discharge air 13 may be formed as a thermometer or else may operate according to the semi-conductor effect. Preferably, the output value in degree Celsius may be input into the control.

Preferably, the sensor 19 is embodied for measuring the volume flow rate as a throughflow sensor with an orifice plate. As an alternative, also the vortex flow measurement may be used, which is realized according to the principle of the swirl flow measurement. Alternative measuring methods may be realized with ultrasonic or in a stagnation pressure probe. Preferably, the output value in $m^3/h$ may be input into the control. Obviously, the sensors 18 and 19 may be combined as well.

The sensor 20 for determining the humidity may be formed as a capacitive thin-film polymer sensor or as a ceramic sensor. Preferably, the output value in $kg/m^3$ absolute humidity or the relative humidity in percent may be input into the control.

The humidity of the web of material 5 upstream the intake 6 of the dryer 1 may as well be mathematically determined, in that the liquid input into the web of material with the mass flow rate of the web of material is input into the control. The method is very precise and only then useful, if the web of material cannot absorb any liquid or only a very small proportion (up to 1%). This applies for example to webs of material made from plastic material, endless filaments or staple fibres made from non-natural fibres, in particular spun-bonded webs, in which the humidity is physically not bound, but just entrained by the surface of the fibres. As an alternative one or more sensors 25 made of ceramics may be used, which by direct contact with the web of material determine the humidity thereof. This is useful in webs of material made from fibres, which are able to absorb and to store humidity (cellulose, fibre blends, cotton).

Again, the sensor 23 for measuring the temperature at the intake 6 of the dryer 1 may be formed as a thermometer or else operate according to the semi-conductor effect. Preferably, the output value in degree Celsius may be input into the control.

Again, the mass flow rate of the web of material at the intake 6 of the dryer 1 may be mathematically determined from the installation parameters or as an alternative by a sensor 24, which operates radiometrically.

Obviously, the values of the web of material 5 entering the dryer 1 for determining the mass balance may at least partially also be measured and another portion be detected or calculated from the upstream installation components. This all depends on the installation configuration and the available values.

Figure 3:
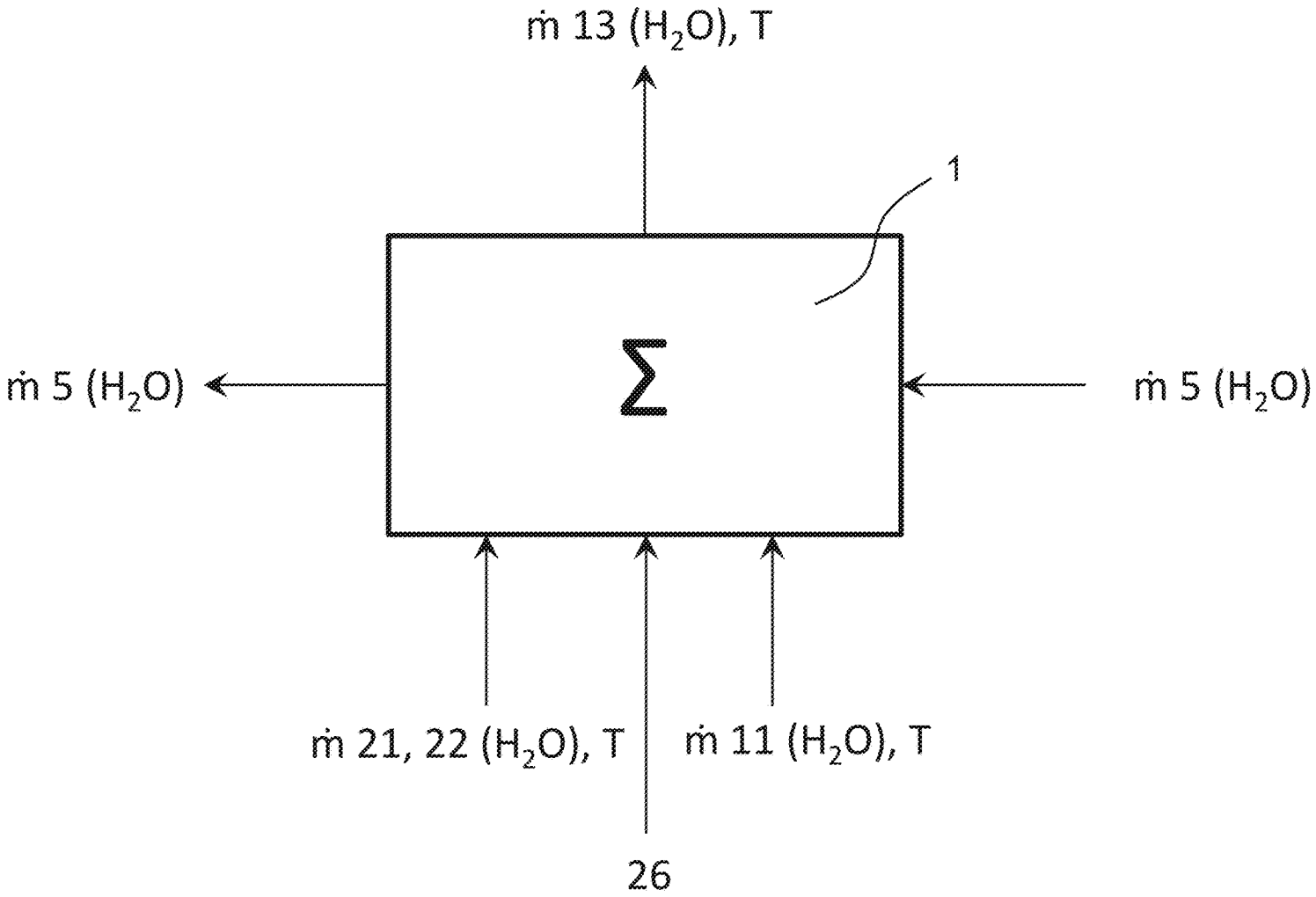
FIG. 3: a diagrammatic illustration of the mass balance of the dryer.

FIG. 3 shows the simplified mass balance/of the drying process, in which a mass flow rate m of the web of material 5 with an absolute or relative humidity H2O enters the dryer 1, and a mass flow rate m of the web of material 5 with an absolute or relative humidity H2O exits from the dryer 1. Further process parameters, which are processed in the dryer 1, are the mass flow rate m of fresh air 11 with an absolute or relative humidity H2O at a temperature to be determined T, and the mass flow rate of humidity H2O at an adjustable temperature T from the heating element 21 (gas burner) or from the heating and fan compartment 22. The mass flow rate m of discharge air 13 with an absolute or relative humidity H2O at a temperature T to be measured will be subtracted. Even though the fan 17 creates a vacuum in the dryer, however, the arrangement of the sensors 18, 19, 20 is realized in the duct 14, where ambient pressure is already present, the parameter pressure may be foregone, because all measurements are realized at the same ambient pressure in the production hall.

As disturbance variables 26 may be considered for the calculation of the mass balance for example false air of the dryer from the production hall, variations in applying the reviving agent of the upstream foulard or of the kiss roll and the potential evaporation, respectively spray off, inaccuracies of the sensors and variations of the entry humidity of the web of material across the working width. Usually, the disturbance variables 26 are empirically determined and may increase or decrease the calculative mass balance.

The inventive device and the associated method are in particular advantageous in spun-bonded webs, because, in contrast to cellulose, spun-bonded webs are not able to store any humidity and therefore insignificant humidity values are given at corresponding high inaccuracies. However, cellulose is almost never dry, because the remaining chalk rests in the cellulose are hygroscopic and thereby, humidity is stored in the fibres. Usually, during the manufacturing process of spun-bonded webs there are no water components in the fibre upstream the kiss roll or the foulard, because only surface water and capillary water is entrained in the web of material. Compared to staple fibre webs, for example made from natural fibres, in spun-bonded webs very little water is entrained, which is hardly measurable. In this case, the inaccuracies of the traditional measuring methods are very disadvantageous and result in variations in the measured values, with which the dryer cannot be operated in a stable manner. The method for determining the mass balance at the small expense for sensor technology is considerably less expensive and more reliable than the measuring technology used so far, by means of which the final humidity is measured in the running web of material.

Figure 4:
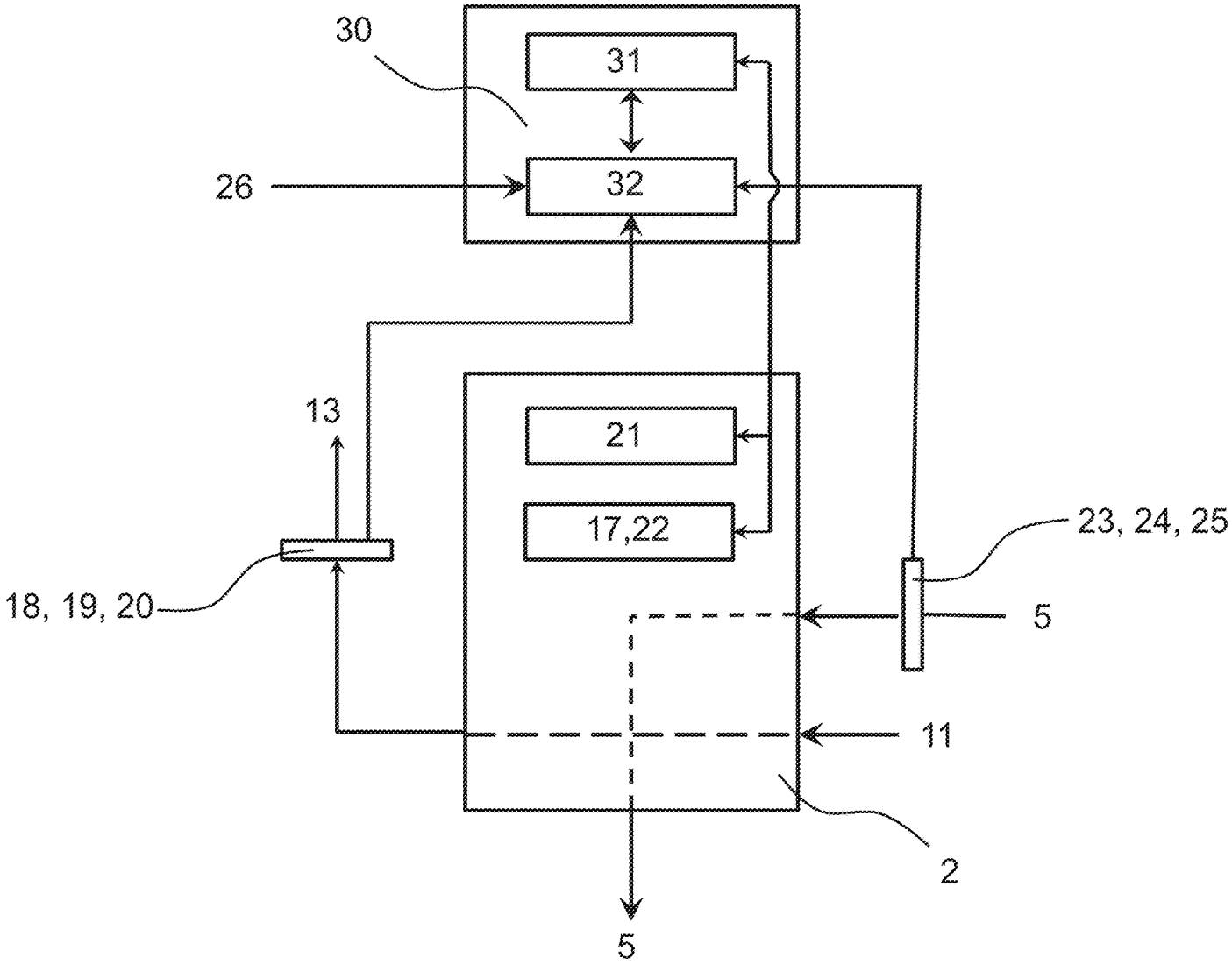
FIG. 4: a control method of the drying process.

Finally, FIG. 4 shows a diagrammatic view of the structure of the control 30 in interaction with a dryer compartment 2 of the dryer 1, wherein by way of example only a single dryer compartment 2 is illustrated. Preferably, the control 30 is an integral component of the dryer 1. However, the control 30 may be as well a component of an entire installation, by means of which the process of manufacturing the web of material as far as to winding the finished web of material on a downstream located lapper is monitored and closed-loop controlled.

The control 30 may include an energy module 31 and a process module 32. The energy module 31 is formed for monitoring at least the heat supply by means of the heating element 21 and/or of the fan 17.

The process module 32 is formed for processing the measured values of the sensors 23, 24, 25 or the calculated values to be input or the detected values for the entry humidity of the web of material 5 in the dryer. Furthermore, the process module 32 processes the measured values of the sensors 18, 19, 20 in the discharge air 13. Simultaneously, the process module 32 also processes the disturbance variables 26, which are input into the control 30 according to the installation configuration and to the web of material to be processed. Instead of the sensor 25 for the humidity of the web of material 5 at the intake 6 of the dryer 1, also a mathematical value for the humidity may be input into the control 30, which is detected based on an upstream installation component, such as a kiss roll. Thereby, the process module 32 is not only able to process direct measured values but also calculated data or input values from the process upstream the dryer 1. Separating the control 30 into a process module 32 and an energy module 31, allows for the use and the wiring of the already existing control of the heating element 21 and/or of the fan 17, respectively of the fan compartment 22 as the energy module 31, wherein then the process module 32 may be formed as a component of a control for the entire installation. The calculation of the mass balance/of the humidity is realized within the process module 32.

The inventively formed control 30 provides for the possibility that for a required residual humidity of the web of textile material 5, when passing through the dryer 1, to supply the corresponding energy for the heat supply by means of the heating element 21 and/or the fan 17 into the drying compartment 10, through which the web of textile material passes in such a manner that a minimum overall energy requirement is achieved. Thus, the energy module 31 carries out a control of the heat supply by means of the heating element 21 and also of the fan 17 or that the dryer compartment 2 is only supplied with a minimum required energy. In particular, a cost-optimized operation of the dryer may be achieved as the cost for power (fan 17, 22) is approximately four times higher than for gas (burner, heating element 21); and the energy module 31 may be operated both energy-optimized and cost-optimized. As many installation operators also have their own gas or power generation, an energy-optimized operation of the dryer may differ from a cost-optimized operation. The control offers the appropriate tool to the installation operator for choosing the optimum operational method.

An ideal drying process is achieved, which reaches a drying air having an optimized proportion of overheated steam for the dryer compartment 2. In the event of a deviation (control deviation) from the specified residual humidity (reference variable) in the web of material 5, the process module 32 controls the energy module 31, which in turn either energy-optimized or cost-optimized, increases or decreases the suctioned amount of air.

When executing the method for operating the dryer 1 with the control 30 in the above-described manner, consequently a dryer 1 is provided, which is self-adjusting to minimum energy use. In this case, the control 30 of the dryer 1 ensures a minimum energy influx into the respective dryer compartment 2 such that the energy consumption is minimized for achieving the required residual humidity of the web of textile material 5. In this case, the respective operating states depend on the quality and the input humidity of the web of textile material such that for example empirical values may be input via an operator panel of the dryer 1, which as control values are necessary for the air conditioning of the individual dryer compartments 2. The values depend for example on the quality, the density, the weight per unit area and the thickness of the web of textile material 5, wherein preferably also the entry humidity and the output humidity of the web of textile material 5 as entry variable are considered for programming the control 30 and for running an appropriate dryer program of the dryer 1.

The exemplary embodiment refers to a dryer having one cylinder 3. In a series dryer, the energization of the heating elements 21 or of the fans 17, respectively of the fan compartment 22 for a dryer compartment 2 having several cylinders 3 to 3*c* may be realized separately, because the humidity absorption of the dryer air decreases from the first cylinder 3 to the last cylinder 3*c*.

It is apparent that only the web of material 5 entering the dryer 1 is monitored with regard to the values temperature, mass flow rate and humidity thereof by means of the sensors or by means of the detected values. Likewise, only the discharge air 13 is monitored with regard to the composition thereof. Based on the mass balance, the dryer 1 is controlled such that the web of material 5 exiting the dryer 1 does not have to be monitored any more with regard to the humidity thereof.

Figure 5:
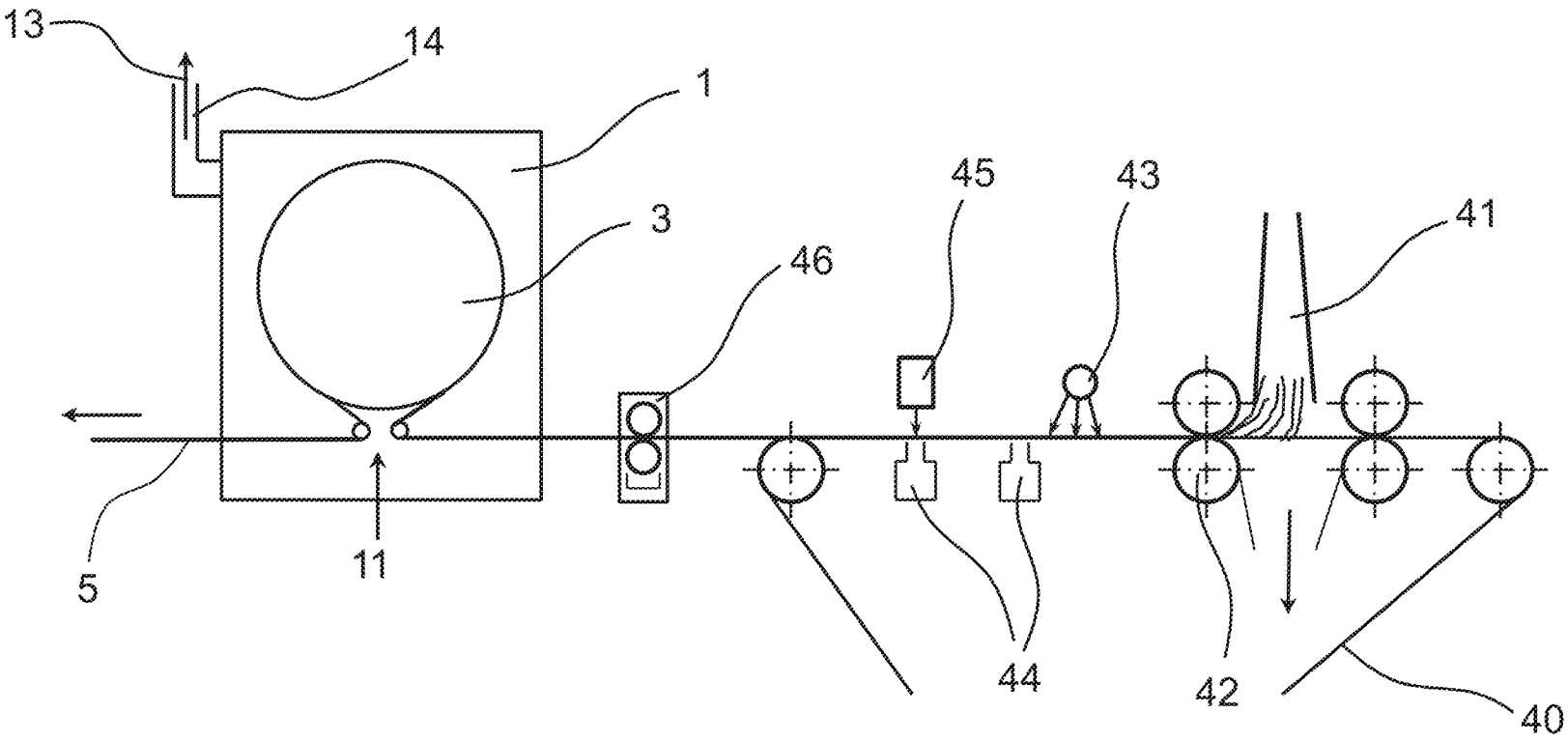
FIG. 5: an installation for manufacturing spun-bonded webs.

The installation according to FIG. 5 diagrammatically shows the manufacture of a spun-bonded web, which is spun in a non-illustrated spinnerette from thermoplastic plastic material, is cooled and, by means of a diffusor 41, is deposited on a circulating conveyor belt 40. Preferably, the conveyor belt is embodied as an air-permeable perforated belt, in order to affix the spun-bonded web on the conveyor belt 40 by a suctioning and to simultaneously remove liquids originating from subsequent treatments. A first pair of discharge rolls 42, which potentially may be heated, may compact the deposited spun-bonded web. After a first humidification by a spray bar 13, by means of which the uniform depositing of the spun-bonded web on the conveyor belt 40 is promoted, because thereby the individual filaments are better fixed, a first suction 44 of the applied liquid is realized. A first entangling 45, for example by means of water jets, may entangle and compact the web of material 5 made from spun-bonded web. Herein as well, excess water is suctioned off via a suction 44. A subsequent treatment device 46, for example a kiss roll or a foulard, apply a treatment liquid onto the web of material 5. A reviving agent may be used as the treatment liquid, by means of which the characteristics of the spun-bonded web are improved in terms of the final product. In the following the web of material 5 passes through a dryer 1, which in this exemplary embodiment is embodied as an Omega dryer with a cylinder 3. In this case, the web of material 5 is adjusted to a predetermined residual humidity, in that the evaporation capacity of the dryer is adjusted, and after having passed through the dryer, the web of material will be supplied to another treatment or to a winding process. In this exemplary embodiment, the fresh air 11 is supplied to the dryer, the humidity content thereof being determined based on the environment data or by means of an idle measurement of the dryer 1. The humidity (volume flow rate, temperature, humidity) of the discharge air 13 is detected in the duct 14 by means of sensors. The humidity content of the web of material 5 entering the dryer may be mathematically determined, measured by means of sensors upstream the intake of the dryer or determined based on the process parameters of the treatment device 46 and input into the control 30. The herein illustrated installation configuration is an example, and may include a further or no entanglement 45 at all for treating the spun-bonded web. Likewise, the installation may be completed with further components, or the humidification 43 downstream the depositing of the spun-bonded web on the conveyor belt may be foregone.

The invention is advantageous in that for determining the residual humidity, the web of material is not compromised (cutting of samples), the web of material may continuously run, and will not be in contact with measuring elements. In this case, the method is independent of production particularities of the web of material, which in a direct (contacting) measurement have a considerable influence on the measured result. Another advantage is provided in that compared to gravimetric, respectively volumetric measuring methods, measuring specific influences of the disturbance variables are eliminated, because the methods only rely on the water mass flow rate. In particular, in spun-bonded webs, in which the mass ratio between web of material and amount of water is disadvantageous, respectively important, small residual humidity values (<1%) for small weights per unit area (e.g. 10 g/m2) may be determined in an operational safe manner, while the web of material is running. As the invention determines the residual humidity of the web of material without contact, the speeds above 500 m/min do not affect the accuracy. Another advantage is the closed-loop control of the dryer for energy optimization, because with a specified residual humidity the dryer capacity will be adapted. In comparison to the previous measuring methods, the invention realizes a very inexpensive and sufficiently precise solution, because expensive sensors do not have to be used.

The invention in the embodiment thereof is not limited to the above-indicated preferred exemplary embodiment. Rather, a number of variants is conceivable, which utilize the illustrated solution, even though basically the embodiments may be different. All the features and/or advantages including constructional particularities or spatial arrangements resulting from the claims, the description or the drawings, may be essential to the invention individually or in the most various combinations.

The invention claimed is:

1. A dryer for a web of textile material, comprising:

at least one dryer compartment including at least one rotatably disposed air-permeable cylinder having an inside and a front-sided opening and around which the web of textile material may partially loop so that a drying heated fresh air flow may flow through the web of textile material;

at least one fan arranged to suction off humid drying air from the inside of the cylinder from the front-sided opening of the at least one cylinder and to discharge the suctioned off humid drying air as discharge air flow through a duct;

at least one humidity determining sensor that produces data representing the humidity of the discharge air flow; and a control coupled to the at least one sensor to process the data with an initial humidity of the web of textile material and a humidity of the fresh air flow, the control being arranged to provide a closed loop control of an evaporative capacity of the dryer as a function of a deviation of the humidity of the discharge air from a desired residual humidity.

2. The dryer according to claim 1, wherein the at least one sensor produces data representing a temperature, a volume and the humidity of the discharge air flow.

3. The dryer according to claim 2, wherein the sensor includes an orifice plate or is formed according to a swirl flow measurement or is formed according to an ultrasonic volume flow rate measurement.

4. The dryer according to claim 1, wherein sensors are disposed at or upstream the dryer for determining at least one of temperature, mass flow rate and the humidity of the web of textile material.

5. The dryer according to claim 1, wherein the control includes an energy module and a process module.

6. The dryer according to claim 1, further including at least one heating element, wherein the control is adapted to control, based upon the desired residual humidity of the web of textile material upon leaving the dryer, at least one of the at least one heating element and the at least one fan to selectively operate the dryer in at least one of an energy-optimized and cost-optimized manner.

7. A method for operating a dryer for a web of textile material with at least one dryer compartment, comprising steps of:

rotatably disposing in the dryer compartment at least one air-permeable cylinder around which the web of textile material partially loops;

flowing a drying heated fresh air flow through the web of textile material;

suctioning off through a duct with at least one fan humid drying air as discharge air from an inside of the at least one air-permeable cylinder from a front-sided opening of the at least one air-permeable cylinder;

detecting values of at least a temperature and a humidity of the fresh air flow;

detecting a value of a temperature, a volume flow rate and a humidity of the discharge air;

detecting values of at least a mass flow rate and a humidity of the web of textile material entering the dryer;

inputting into a control a value for a reference variable for a desired residual humidity of the web of textile material;

calculating an evaporative capacity of the dryer from the detected values in a control; and upon deviation of the evaporative capacity of the dryer from the reference variable, controlling at least one of the at least one heating element and the at least one fan while selectively considering at least one of an energy optimization and a cost optimization.

8. The method according to claim 7, further including detecting the humidity and the temperature of the fresh air in the duct prior to starting the dryer.

9. The method according to claim 7, including using sensors to detect the humidity, the temperature and the volume flow rate of the fresh air flow and of the discharge air.

10. The method according to claim 7, wherein the detecting the mass flow rate and the humidity of the web of textile material is realized by sensors or mathematically determined or determined with operational data of an upstream installation component.

11. The method according to claim 7, inputting and processing with the control disturbance variables including at least one of false air at the dryer, non-homogenous reviving agent of the web of textile material and/or fluctuations of humidity across a working width of the web of textile material.

12. A module for use at a dryer for determining a residual humidity of a dried web of textile material, comprising: a control with at least one process module for calculating a mass balance of a specific or relative humidity of fresh air, discharge air and the web of textile material; an energy module for controlling at least one heating element and/or at least one fan; and sensors for determining the temperature, the humidity and the volume flow rate of the fresh air and the discharge air of the dryer.

13. The module according to claim 12, additionally including sensors for determining a temperature of a mass flow and/or a humidity of a continuously running web of textile material.

14. The module according to claim 12, including an interface or an input device for inputting disturbance variables.

15. An installation for manufacturing spun-bonded webs from endless filaments, comprising: at least one spinneret in which endless filaments are spun from a thermoplastic plastic material; a diffuser; a conveyor belt on which the spun-bonded fibers are deposited by the diffuser and subsequently cooled; means for pretreating the spun-bonded web by humidification and/or entangling, and a dryer according to claim 1 arranged to dry the spun-bonded web following a treatment device to the desired residual humidity.

* * * * *